US006964065B2

(12) United States Patent
Stevenson

(10) Patent No.: US 6,964,065 B2
(45) Date of Patent: Nov. 15, 2005

(54) WOMEN'S UNDERGARMENT AND COMPATIBLE OVERGARMENT

(76) Inventor: Jane M Stevenson, P.O. Box 1810, Norwich, VT (US) 05055

( * ) Notice: Subject to any disclaimer, the term of this patent is extended or adjusted under 35 U.S.C. 154(b) by 33 days.

(21) Appl. No.: 10/813,247

(22) Filed: Mar. 30, 2004

(65) Prior Publication Data

US 2004/0210990 A1 Oct. 28, 2004

Related U.S. Application Data

(60) Provisional application No. 60/464,827, filed on Apr. 23, 2003.

(51) Int. Cl.[7] ..... A41D 9/00

(52) U.S. Cl. ..... 2/400; 2/405; 2/406; 2/69

(58) Field of Search ..... 2/400–408, 67, 2/70–75, 79, 80, 227, 228, 238, 78.1–78.4, 73, 247; 450/102–105; 604/395, 396, 385.2

(56) References Cited

U.S. PATENT DOCUMENTS

| | | | | |
|---|---|---|---|---|
| 3,823,721 A | | 7/1974 | Herbener | 450/100 |
| 3,840,900 A | * | 10/1974 | Cruz | 2/77 |
| 4,597,110 A | | 7/1986 | Smith, Sr. et al. | 2/408 |
| 4,835,795 A | * | 6/1989 | Lonon | 2/408 |
| 5,239,706 A | * | 8/1993 | Stevenson | 2/408 |
| D403,487 S | | 1/1999 | Crupi et al. | D2/731 |
| 5,876,395 A | | 3/1999 | Hart et al. | 604/393 |
| 5,966,747 A | | 10/1999 | Crupi et al. | 2/466 |
| D419,280 S | | 1/2000 | Hines | D2/712 |
| D429,384 S | | 8/2000 | Crupi et al. | D29/100 |
| D441,917 S | | 5/2001 | L'Abbe et al. | D29/100 |
| 6,308,340 B1 | * | 10/2001 | Cook | 2/400 |
| 6,324,699 B1 | | 12/2001 | Cosmah | 2/239 |

OTHER PUBLICATIONS

Hatfield, J., "At last, clothes that make it easier to heed nature's call," *The Boston Globe*, Sep. 14, 1995.

* cited by examiner

*Primary Examiner*—Gloria M. Hale
(74) *Attorney, Agent, or Firm*—Woodcock Washburn LLP

(57) ABSTRACT

The present invention provides an undergarment, alone or in combination with a compatible overgarment. Also, an embodiment of the present invention includes a bodysuit comprising a torso section and an undergarment section. Undergarments of the present invention comprise a crotch panel for covering a crotch opening. In a closed position, the crotch panel is fixably attached to a back panel and is releasably attached to a front panel. The crotch panel is slidable from front to back which permits bodily waste elimination without the need for disrobing. In the open position, the crotch panel can be secured to the back panel. Methods of facilitating elimination of bodily waste are also provided by the present invention.

27 Claims, 4 Drawing Sheets

WOMEN'S UNDERGARMENT AND COMPATIBLE OVERGARMENT

CROSS-REFERENCE TO RELATED APPLICATION

This claims the benefit of priority under 35 U.S.C. § 119(e) from provisional U.S. Application Ser. No. 60/464,827, filed on Apr. 23, 2003, incorporated herein by reference.

FIELD OF THE INVENTION

The present invention relates to undergarments which can be used separately or in combination with overgarments such as slacks, wherein the undergarments are provided with an easily opened and closed crotch panel allowing body waste elimination without disrobing, and the overgarments provide access to the crotch panel.

BACKGROUND OF THE INVENTION

During the latter part of the twentieth century, it has become customary for many women to wear pants for everyday, business, athletic, travel and other outdoor activities. Such garments both allow and foster women's varied activities outside the home, as they are comfortable and facilitate movement of the body. These convenient garments however do not provide the same facility as men enjoy when it comes to urination. Because men's outer and under garments each have an openable/closable crotch, they have the convenience of standing and not disrobing for urination. Men's garments allow the belt, shirt, waistband and underwear to remain conveniently in place on a man's body during urination. There have been no similar garments for women. When wearing slacks or other legged garments since "bloomers," were invented, women have had to undo some or all of the following: belt, button, snaps, zipper, panties and remove them from the lower torso in order to urinate. This process can be both time-consuming and disconcerting especially when private parts of the body must be exposed.

Especially in public places, partially disrobing may cause the garments to drag on the ground where they may become soiled or wet. If one uses a "hovering" technique rather than sit on the toilet seat, substantial physical, e.g., muscular, control is necessary. Older women and physically-challenged women, as well as women who simply have to manage packages or heavy outer garments in a public restroom have similar problems. In outdoor activities such as hiking and camping, disrobing can also be undesirable because of the lack of privacy, since there are often no toilet facilities. Also in outdoor situations when the weather is adverse it can be undesirable to disrobe and expose one's body to the elements.

The problem of disrobing has been addressed in part by U.S. Pat. No. 4,597,110 and U.S. Pat. No. 4,835,795, which relate to openable undergarments. These undergarments have front opening flaps which must be fastened or otherwise maintained out of the way. If these undergarments are used in combination with a bifurcated overgarment it may require pulling the flap through an opening in the overgarment, then repositioning the flap under the overgarment and refastening the flap to the undergarment. This process requires several motions and is time-consuming. The problem of a flap has been overcome in part for undergarments by the flapless undergarment disclosed in U.S. Pat. No. 3,823,721. However, the undergarment does not have means for securing the garment in a closed position. Furthermore, none of these garments provide a bifurcated overgarment which can be used in combination with undergarments.

U.S. Pat. No. 6,324,699 describes a "pantyhose undergarment with crotch flap" designed to provide an openable crotch for pantyhose. A flap is disclosed that requires use of the wearer's hands for the purpose of holding the flap out of the way. The pantyhose has to be reclosed at different points in the crotch area which is inconvenient and perhaps unsanitary. Also, there is no provision for a compatible bifurcated overgarment and therefore it is presumably more suitable for wearing with skirts.

U.S. Pat. No. 5,239,706 discloses "underpants and coordinated bifurcated overgarment." The undergarment described in U.S. Pat. No. 5,239,706 provides a flapless garment with a slidable crotch.

There is a continuing need for convenience garments designed for women which allow the wearer to eliminate body waste without disrobing and to stand for urination if necessary.

SUMMARY OF THE INVENTION

Women's undergarments, compatible overgarments, and bodysuits are provided by the present invention. Embodiments of the present invention provide flapless undergarments comprising crotches that do not get in the way during waste elimination, e.g., urination. In addition, embodiments of the present invention comprise easily openable and closeable crotches.

The use of compatible overgarments in accordance with the present invention permits convenient access to the flapless undergarment. Overgarments of the present invention are adaptable to most designs of garments, such as slacks, jeans, shorts, jumpsuits, overalls, as well as skirts.

Bodysuits in accordance with the present invention can be adapted for use as, but not limited to, professional uniforms, dressy blouses, and casual shirts. For example, a torso of a bodysuit can be constructed to comply with uniform standards set forth by particular professions, while being attached to an undergarment. As such, the torso of the uniform would remain tucked in during normal activities, which would permit free movement while maintaining a neat appearance and facilitating waste elimination.

Benefits of the present invention include, but are not limited to, the ability to keep a wearer's hands free while garment is in the opened position, to stand for urination, to keep any garment waistbands in place while urinating, to keep clothes off the floor while urinating, to keep the body covered while urinating, to eliminate body contact with the toilet, and to keep the body covered while urinating in situations when there is lack of privacy, no facilities, or adverse environmental conditions.

The present invention relates to an undergarment, alone or in combination with a compatible overgarment. Also, an embodiment of the present invention includes a bodysuit comprising a torso section and an undergarment section. An undergarment in accordance with the present invention encircles the lower torso of the wearer from any point above the crotch to the crotch. There is a crotch opening between the front of the undergarment and the back of the undergarment that covers the area between the legs. Front and back panels have attached thereto a left leg band and a right leg band which are spaced apart and span the crotch opening. A front panel comprises a free edge situated between the left leg band and the right leg band.

A crotch panel for covering the crotch opening is provided. The crotch panel has a left casing and a right casing. The left casing slidably engages a portion of the left band and the right casing slidably engages a portion of the right band. It is further preferred, although not essential, that the bands are flat and that the casings have a width which is only slightly greater than the width of the bands. Having the casing width so sized will help prevent the bands from twisting. Alternatively, the bands may not be flat and the casings of any width wider than the band.

The crotch panel is fixably attached to the back of the undergarment and comprises a free edge. When the casings are slidably engaged with the bands, such that the casings substantially cover the bands, the crotch panel is in a closed position, thereby covering the crotch opening of the undergarment. In the closed position, the free edge of the crotch panel can be fastened to the free edge of the front panel by any fasteners known in the art, for example, but not limited to, hook and pile fasteners, e.g., VELCRO®, or a snap. When the crotch panel and the casings are slid from front to back, the leg bands are exposed and the crotch panel is in an open position. In the open position, the free edge of the crotch panel can be fastened to the back panel by any fasteners know in the art, for example, but not limited to, a hook and pile fastener, e.g., VELCRO®, or a snap.

Preferably the left leg band and the right leg band are made of an elastic material. The elasticity of the bands helps maintain the crotch panel in close proximity to the body. It is further preferred that the crotch panel is fabricated from stretchable material, and that the material is a two way stretchable material such as Lycra® spandex or any of newly developed polymers or even natural fibers. Such material in combination with the elastic bands helps maintain the crotch panel in close proximity to the body when the panel is in the closed position.

It is understood that undergarments of the present invention, made using manufacturing processes understood in the art, may utilize separate front panels, back panels, and crotch panels, which then require further seaming together. It is also within the spirit of the present invention to utilize front and back panels that are continuously knitted or manufactured together. Furthermore, crotch panels continuously knitted or manufactured together with the back panels are also contemplated by the present invention.

It may be desirable that undergarments of the present invention comprise a pocket. The pocket would be suitable for storing necessities, such as tissues or personal care products, which can be inconvenient to carry. The pocket could be located on either the front panel or the back panel. The pocket may comprise a free edge that can optionally be fastened to either the front panel or the back panel.

Undergarments in accordance with the present invention may comprise a waistband attached to the front panel and the back panel. The waistband can be integral with the front and back panels. The waistband could comprise elastic.

Overgarments can be provided for use with undergarments according to the present invention. When used with undergarments of the present invention, overgarments comprise a trunk area which encloses said underpants, a left leg area attached to said trunk, a right leg area attached to said trunk, and an overgarment opening which permits access to said crotch panel. The overgarment opening can comprise an overgarment fastener to secure said overgarment opening in a closed position. Suitable fasteners, which are understood by those skilled in the art, can include, but are not limited to a zipper, a snap, or a hook and pile fastener. Combinations of an undergarment and an overgarments can be provided wherein the undergarment is releasably attached to the overgarment. It may also be desirable to provide combinations wherein the undergarment is fixably attached to said overgarment.

Bodysuits in accordance with the present invention comprise a torso section and an undergarment section. The torso section comprises arm holes and a neck opening. It is understood that the torso section is not limited in its overall appearance, as it can be constructed, for example, to comply with military regulations for uniforms. The torso may be suitable for use in any areas that may require uniforms, such as, but not limited to: soldiers, police, airline attendants, waitresses, mail carriers, health care workers, and athletes. Further, both casual shirts and dressy blouses can incorporate the benefits of bodysuits of the present invention. In order to adapt to the limitless applications of the bodysuits of the present invention, the torso may further comprise adornments such as, but not limited to buttons, pockets, collars, cuffs, zippers, snaps, and combinations thereof.

A method of facilitating elimination of bodily waist by a woman is provided by the present invention. A woman wearing an undergarment or a bodysuit in accordance with the present invention can open the crotch panel by detaching the free edge of the crotch panel from the free edge of the front panel. This can be accomplished by grasping the crotch panel and pulling back towards the woman's backside. As the panel moves toward the rear, the crotch panel casings slide along the bands and the crotch panel gathers into folds. A woman can further secure the free edge of the crotch panel to the back panel with a fastener. A woman can also store necessities in a pocket of the undergarment. When an undergarment is worn with a compatible overgarment, the crotch panel can be accessed through an overgarment opening prior to detaching the crotch panel free edge from the front panel free edge.

DETAILED DESCRIPTION

The present invention relates to an undergarment, alone or in combination with a compatible overgarment. Also, embodiments of the present invention include women's bodysuits. In the following description, like numbers in different figures represent the same features.

Figure 1A:
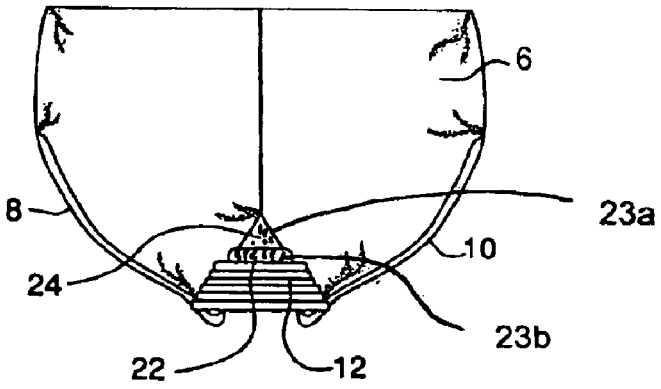
FIGS. 1A and 1B provide back and front views, respectively, of one embodiment of the present invention where the crotch panel is open.
Figure 1B:
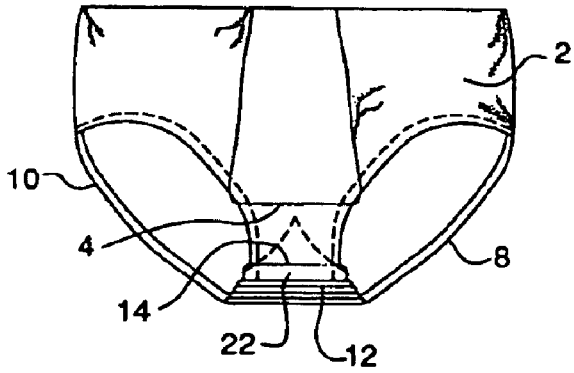
Figure 1C:
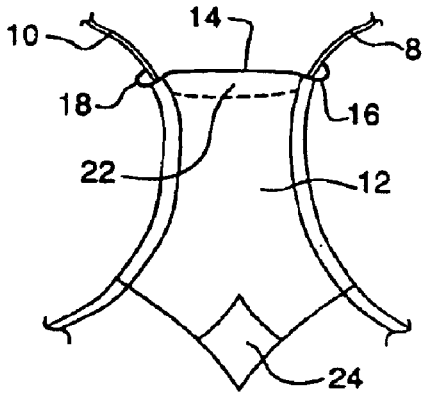
FIG. 1C is a planar view of the crotch panel.

FIGS. 1A and 1B provide back and front views, respectively, of one embodiment of the present invention where the crotch panel is open. FIG. 1C is a planar view of the crotch panel. An undergarment encircles the lower torso of a wearer from any point above the crotch to the crotch, comprising a front panel 2 and a back panel 6. Front panel 2 may be of any size or shape. Back panel 6 may be of any size or shape. Accordingly, the undergarment may be in the form of a short, brief, bikini, or thong. The front panel comprises a free edge 4. Attached to the front and back panels are a left leg band 8 and a right leg band 10. A crotch panel 12 is provided for covering a crotch opening and is fixably attached to the back panel 6. The crotch panel 12 has a free edge 14, a left casing 16, and a right casing 18. The left casing 16 slidably engages a portion of the left leg band 8 and the right casing 18 slidably engages a portion of the right leg band 10. The bands can be flat and the casings can be sized to a width which is only slightly greater than the width of the bands.

In an open position, the free edge 14 of the crotch panel 12 is detached from free edge 4 of the front panel 2. The crotch panel 12 can be secured to the back panel 6 in open position with a fastener 23*a* and 23*b*, for example, VELCRO® (hook and pile,) between an area 22 on the crotch panel 12 and an area 24 on the back panel 6.

Figure 2A:
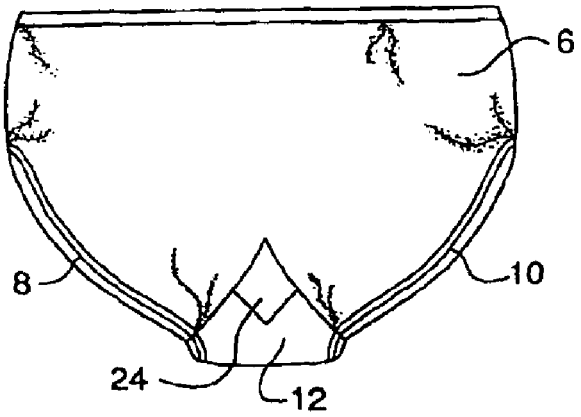
FIGS. 2A and 2B provide back and front views, respectively, of one embodiment of the present invention where the crotch panel is closed.
Figure 2B:
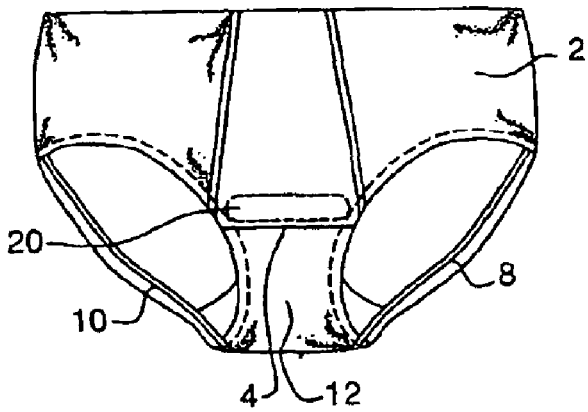

FIGS. 2A and 2B provide back and front views, respectively, of one embodiment of the present invention where the crotch panel is closed. In a closed position, the free edge of the front panel 4 is secured to the crotch panel 12 with a fastener, for example, VELCRO® (hook and pile). An area 20 on the underneath part of the front panel 2 secures to an area 22 (not shown in FIG. 2B) on the crotch panel 12. When the casings 16 and 18 are slidably engaged with the bands 8 and 10, respectively, the crotch panel is in the closed position, thereby covering the crotch opening of the undergarment.

Figure 3:
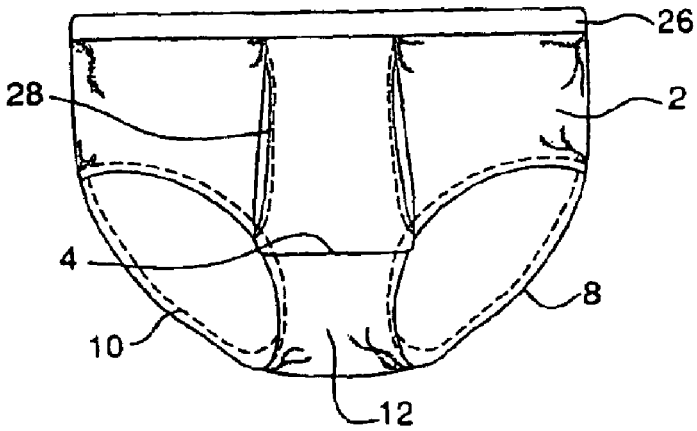
FIG. 3 is a front view of one embodiment of the present invention depicting optional features such as a waistband and a pocket.

FIG. 3 is a front view of one embodiment of the present invention depicting optional features such as a waistband 26 and a pocket 28. It is understood that a waistband 26 may be desirable is certain applications of the present invention. Furthermore, a pocket 28 may be suitable for storing necessities, such as, tissues or personal care products, for example tampons and/or minipads, which can be inconvenient to carry. The location of the pocket 28 is not fixed, as it is possible that a pocket on the back panel may be desirable.

Figure 4:
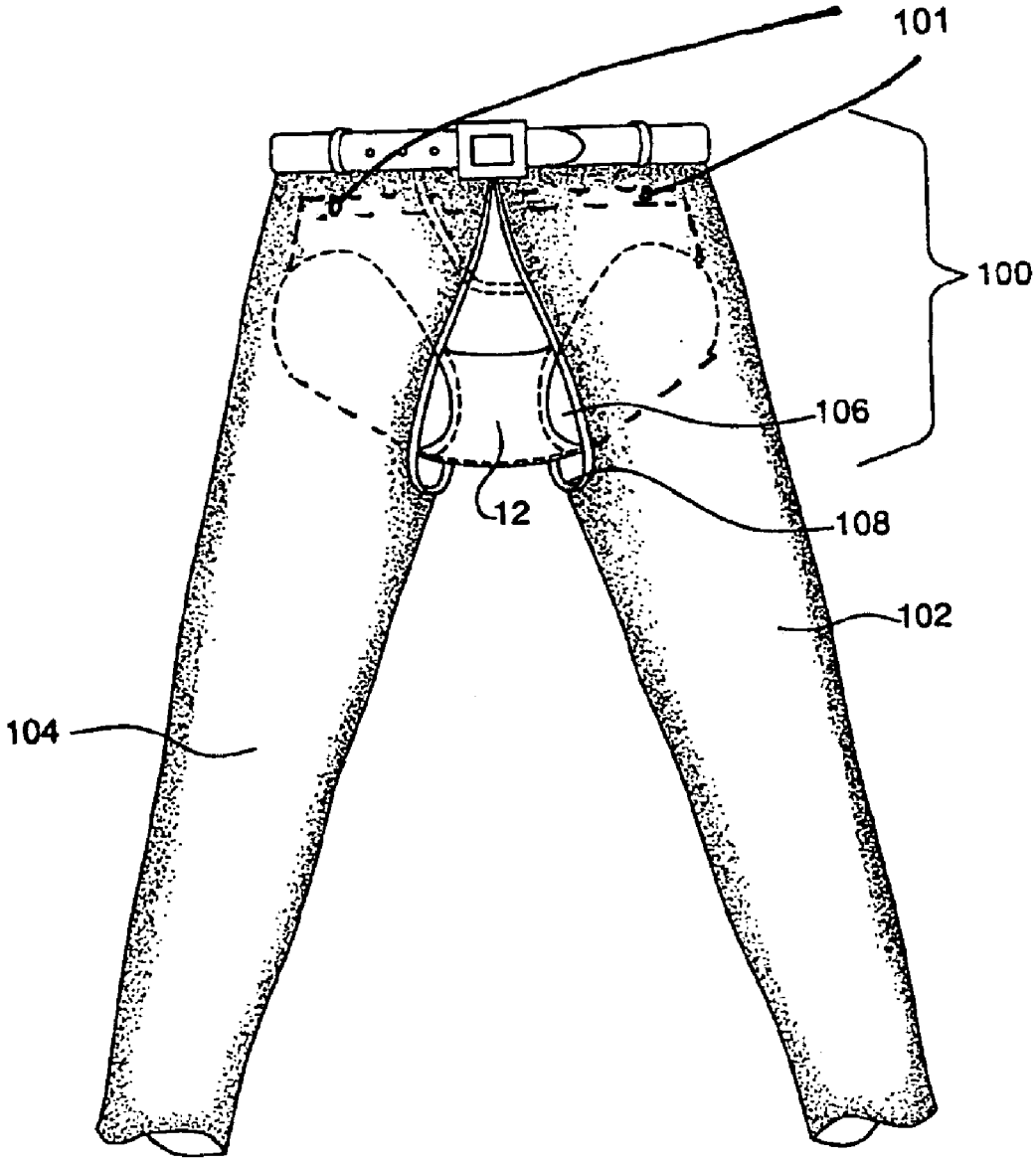
FIG. 4 shows an embodiment of an overgarment in accordance with the present invention, where an overgarment opening is in an open position.

FIG. 4 shows an embodiment of an overgarment for use with an undergarment in accordance with the present invention, where an overgarment opening is in an open position. Overgarments can comprise a trunk area 100, which encloses an undergarment, left and right leg areas, 102 and 104 respectively, which are attached to the trunk area, and an overgarment opening 106. The overgarment opening 106 permits access to a crotch panel 12 of an undergarment. The overgarment opening can comprise an overgarment fastener 108 to secure the overgarment opening in a closed position. Suitable fasteners, as understood by those skilled in the art, can include, but are not limited to, a zipper, a snap, or a hook and pile fastener, e.g. VELCRO® (hook and pile). An undergarment of the present invention can be optionally attached as desired to an overgarment with a fastener 101. Attachment can be releasable or fixed.

Figure 5:
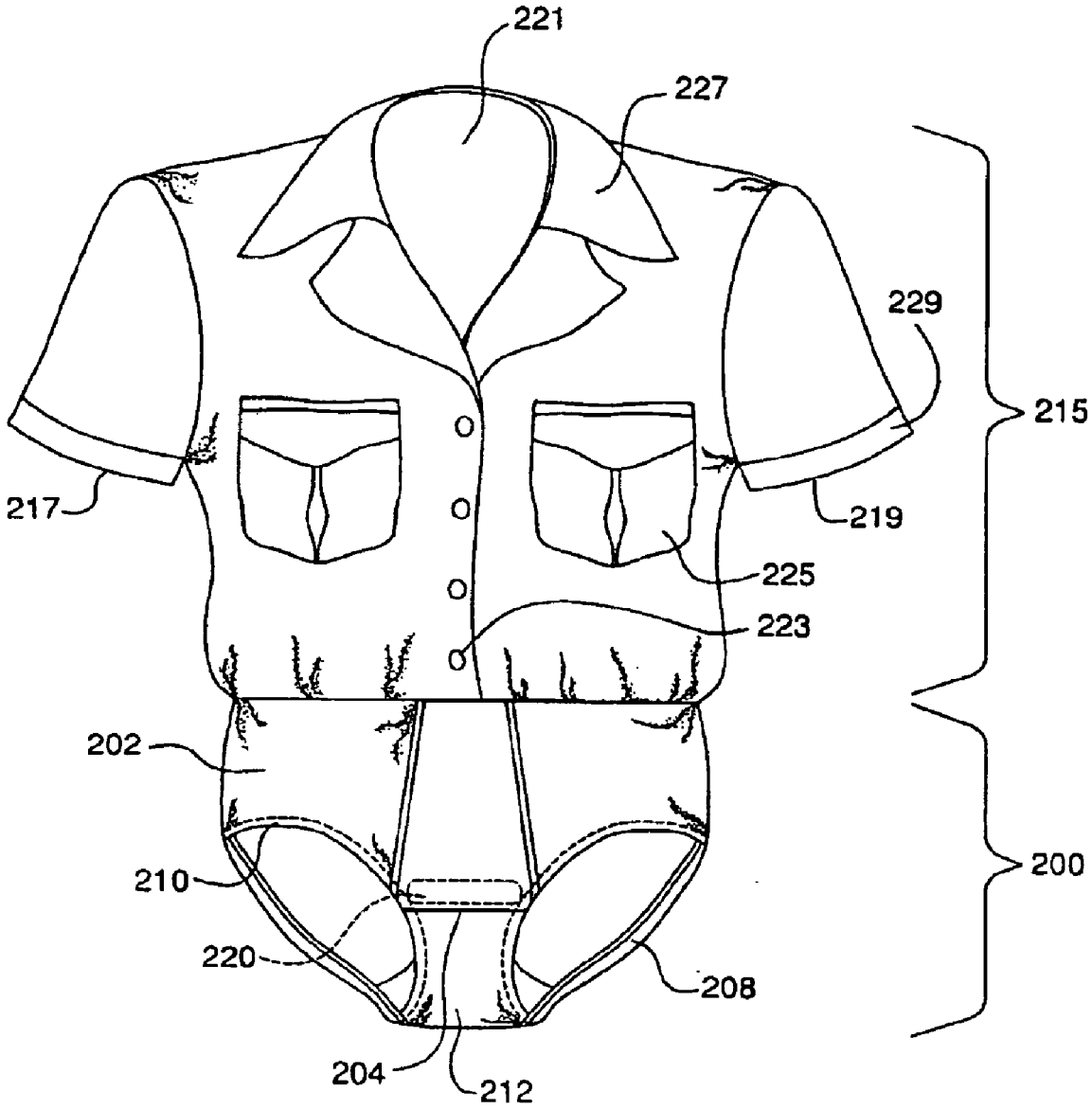
FIG. 5 depicts an embodiment of a bodysuit in accordance with the present invention.

FIG. 5 depicts an embodiment of a bodysuit in accordance with the present invention. A bodysuit comprises a torso section 215 and an undergarment section 200 attached to the torso section 215. The torso section comprises a neck opening 221, a left arm hole 219, and a right arm hole 217. The undergarment section 200 comprises a front panel 202, which comprises a free edge 204; a back panel (not shown); left and right leg bands, 208 and 210, respectively, attached to the front and back panels; and a crotch panel 212, which comprises a free edge, and left and right casings (not shown). The crotch panel 212 is fixably attached to the back panel. The left and right casings are slidably engaged with the left and right leg bands, respectively. As such, the crotch panel 212 can be in a closed position, as depicted in FIG. 5, where an area of the crotch panel is secured to an area 220 on the underneath part of the free edge 204 of the front panel 202. In an open position, not shown, the crotch panel 212 can be detached from the free edge 204 and slid towards the backside of the wearer and secured to the back panel. As discussed above, the torso section can be adapted for limitless uses, and supplemental adornments can be added as desired, including, but not limited to a button 223, a pocket 225, a collar 227, a cuff 229, a zipper, a snap, and combinations thereof.

Another aspect provided by the present invention is a method of facilitating elimination of bodily waist by a woman. A woman wearing an undergarment or a bodysuit in accordance with the present invention can open the crotch panel by detaching the free edge of the crotch panel from the free edge of the front panel. This can be accomplished by grasping the crotch panel and pulling back towards the woman's backside. As the panel moves toward the rear, the crotch panel casings slide along the bands and the crotch panel gathers into folds. A woman can further secure the free edge of the crotch panel to the back panel with a fastener. A woman can also store necessities in a pocket of the undergarment. When an undergarment is worn with a compatible overgarment, the crotch panel can be accessed through an overgarment opening prior to detaching the crotch panel free edge from the front panel free edge.

Other aspects of the invention will be apparent from review of the present specification and claims and all such falling within the spirit of the invention are comprehended hereby.

What is claimed is:

1. An undergarment for a woman comprising:

a front panel comprising a first free edge;

a back panel;

a left leg band attached to said front panel and said back panel;

a right leg band attached to said front panel and said back panel;

a crotch panel comprising a second free edge, a left casing, and a right casing, wherein said crotch panel is fixably attached to said back panel, wherein said left casing slidably engages with said left leg band, and wherein said right casing slidably engages with said right leg band;

thereby providing a crotch panel which is slidable from front to back.

2. The undergarment of claim 1 wherein said second free edge is releasably secured to said first free edge with a fastener during regular wear of said undergarment.

3. The undergarment of claim 2 wherein said fastener comprises a hook and pile fastener.

4. The undergarment of claim 1 wherein said second free edge is releasably secured to said back panel with a fastener after said crotch panel is slid from front to back.

5. The undergarment of claim 1 wherein said front panel and said back panel are continuously knitted.

6. The undergarment of claim 5 wherein said crotch panel is continuously knitted with said back panel.

7. The undergarment of claim 1 wherein said right leg band and said left leg band comprise elastic.

8. The undergarment of claim 1 wherein said crotch panel comprises a stretchable material.

9. The undergarment of claim 1 further comprising a pocket.

10. The undergarment of claim 1 further comprising a waistband which is attached to said front panel and to said back panel.

11. The undergarment of claim 10 wherein said waistband is integral with said front panel and with said back panel.

12. The undergarment of claim 10 wherein said waistband is elastic.

13. A method of facilitating elimination of bodily waste by a woman comprising:

wearing an undergarment comprising a front panel comprising a first free edge; a back panel; a left leg band attached to said front panel and said back panel; a right leg band attached to said front panel and said back panel; a crotch panel comprising a second free edge, a left casing, and a right casing, wherein said crotch panel is attached to said back panel, wherein said left casing slidably engages with said left leg band, and wherein said right casing slidably engages with said right leg band; wherein said second free edge is releasably secured to said first free edge with a first fastener;

detaching said second free edge from said first free edge; and sliding said crotch panel towards the woman's backside.

14. The method of claim 13 further comprising securing said second free edge to said back panel with a second fastener.

15. The method of claim 13, wherein said undergarment further comprises a pocket, further comprising storing necessities in said pocket.

16. The method of claim 13, wherein obtaining access to said crotch panel through an overgarment opening occurs prior to detaching said second free edge from said first free edge.

17. A compatible overgarment and undergarment wherein said undergarment comprises:

a front panel comprising a first free edge;

a back panel;

a left leg band attached to said front panel and said back panel;

a right leg band attached to said front panel and said back panel;

a crotch panel comprising a second free edge, a left casing, and a right casing, wherein said crotch panel is fixably attached to said back panel, wherein said left casing slidably engages with said left leg band, and wherein said right casing slidably engages with said right leg band;

thereby providing a crotch panel which is slidable from front to back; said overgarment comprises:

a trunk area which encloses said underpants;

a left leg area attached to said trunk;

a right leg area attached to said trunk; and an overgarment opening which permits access to said crotch panel.

18. The combination of claim 17 wherein said overgarment opening comprises an overgarment fastener to secure said overgarment opening in a closed position.

19. The combination of claim 18 wherein said overgarment fastener comprises a zipper.

20. The combination of claim 19 wherein said undergarment is releasably attached to said overgarment.

21. The combination of claim 17 wherein said undergarment is fixably attached to said overgarment.

22. A bodysuit for a woman comprising:

a torso section wherein said torso section comprises a left arm hole;

a right arm hole; and a neck opening; and an undergarment section attached to said torso section wherein said undergarment comprises:

a front panel comprising a first free edge;

a back panel;

a left leg band attached to said front panel and said back panel;

a right leg band attached to said front panel and said back panel;

a crotch panel comprising a second free edge, a left casing, and a right casing, wherein said crotch panel is fixably attached to said back panel, wherein said left casing slidably engages with said left leg band, and wherein said right casing slidably engages with said right leg band;

thereby providing a crotch panel which is slidable from front to back.

23. The bodysuit of claim 22 wherein said torso further comprises an adornment selected from the group consisting of: a button, a pocket, a collar, a cuff, a zipper, a snap, and combinations thereof.

24. The undergarment of claim 1 wherein said crotch panel is adapted to slide under said free edge when said crotch panel is in a closed position.

25. The method of claim 13 wherein said crotch panel is adapted to slide under said free edge when said crotch panel is in a closed position.

26. The combination of claim 17 wherein said crotch panel is adapted to slide under said free edge when said crotch panel is in a closed position.

27. The bodysuit of claim 22 wherein said crotch panel is adapted to slide under said free edge when said crotch panel is in a closed position.

* * * * *